US007641190B2

(12) United States Patent
Hara et al.

(10) Patent No.: US 7,641,190 B2
(45) Date of Patent: Jan. 5, 2010

(54) MEDIUM TRAY AND IMAGE RECORDING APPARATUS USING THE SAME

(75) Inventors: Shinjiro Hara, Tokyo (JP); Kenichi Egawa, Tokyo (JP); Hidenori Ueda, Tokyo (JP); Moriaki Fukao, Tokyo (JP)

(73) Assignee: Oki Data Corporation, Tokyo (JP)

( * ) Notice: Subject to any disclaimer, the term of this patent is extended or adjusted under 35 U.S.C. 154(b) by 356 days.

(21) Appl. No.: 10/617,791

(22) Filed: Jul. 14, 2003

(65) Prior Publication Data

US 2004/0012141 A1 Jan. 22, 2004

(30) Foreign Application Priority Data

Jul. 12, 2002 (JP) ..... 2002-203778

(51) Int. Cl.
*B65H 1/00* (2006.01)

(52) U.S. Cl. ..... 271/145; 271/161; 271/162

(58) Field of Classification Search ..... 271/145, 271/165, 171, 207, 213, 9.09, 9.1, 161, 162, 271/188, 209, 220, 223; 399/393, 405; 347/104; 400/646, 647, 647.1
See application file for complete search history.

(56) References Cited

U.S. PATENT DOCUMENTS 4,306,713 A * 12/1981 Avritt et al. ..... 271/37
4,355,798 A * 10/1982 Villa ..... 271/21
4,365,793 A * 12/1982 Van Blokland et al. ..... 271/3.05
4,415,263 A * 11/1983 Hoffman ..... 399/162
4,445,647 A * 5/1984 Deeg et al. ..... 242/598.4
4,558,858 A * 12/1985 Runzi ..... 271/22
4,560,157 A * 12/1985 Hirschberg ..... 271/126
4,565,360 A * 1/1986 Runzi ..... 271/4.04
4,711,442 A * 12/1987 Runzi ..... 271/22
4,720,728 A * 1/1988 Kando ..... 399/405
5,111,252 A * 5/1992 Hamada et al. ..... 399/393
5,114,133 A * 5/1992 Osada et al. ..... 271/22
5,137,172 A * 8/1992 Wagner et al. ..... 221/26
5,137,174 A * 8/1992 Bell ..... 271/161
5,240,243 A * 8/1993 Gompertz et al. ..... 271/209
5,280,897 A * 1/1994 Maekawa ..... 271/3.03
D344,751 S * 3/1994 Keong ..... D18/49
5,292,112 A * 3/1994 Hirota et al. ..... 271/3.03

(Continued)

FOREIGN PATENT DOCUMENTS

EP 165126 A1 * 12/1985

(Continued)

*Primary Examiner*—Patrick H Mackey
*Assistant Examiner*—Jeremy Severson
(74) *Attorney, Agent, or Firm*—Kubotera & Associates, LLC

(57) ABSTRACT

A medium tray (101) comprises a medium support (1) connected to a medium feeding section (100) of an image recording apparatus (200) and receiving record medium (P), and a medium guide (5) extending from the medium support (1) and supporting the record medium (P) such that an angle of a rear portion of the record medium (P) is changed. A lengthy record medium (P) having a length greater than the medium support (1) is supported by the medium guide (5) with the rear portion thereof directed at a different angle so that the length record medium (P) is loaded in the medium tray (101) without enlarging an area projecting from the image recording apparatus (200).

23 Claims, 18 Drawing Sheets

U.S. PATENT DOCUMENTS

| | | | | | |
|---|---|---|---|---|---|
| 5,316,287 | A | * | 5/1994 | Hiroi et al. | 271/213 |
| 5,421,570 | A | * | 6/1995 | Hube et al. | 271/145 |
| 5,464,205 | A | * | 11/1995 | Bang | 271/213 |
| 5,613,672 | A | * | 3/1997 | Tanaka et al. | 21/162 |
| 5,775,687 | A | * | 7/1998 | Nakatani et al. | 271/145 |
| 5,927,702 | A | * | 7/1999 | Ishii et al. | 271/9.09 |
| 5,984,300 | A | * | 11/1999 | Nishiberi | 271/171 |
| 6,070,868 | A | * | 6/2000 | Nagato et al. | 271/145 |
| 6,264,386 | B1 | * | 7/2001 | Sugahara | 400/578 |
| 6,469,811 | B1 | * | 10/2002 | Tamura | 358/498 |
| 6,612,561 | B2 | * | 9/2003 | Sekine | 271/3.14 |
| 6,830,328 | B2 | * | 12/2004 | Cuyler, Jr. | 347/104 |
| 2001/0013679 | A1 | * | 8/2001 | Fukuda | 271/188 |

FOREIGN PATENT DOCUMENTS

| | | | | |
|---|---|---|---|---|
| JP | 55135049 | A | * | 10/1980 |
| JP | 60118569 | A | * | 6/1985 |
| JP | 61254430 | A | * | 11/1986 |
| JP | 63127974 | A | * | 5/1988 |
| JP | 63295325 | A | * | 12/1988 |
| JP | 02100927 | A | * | 4/1990 |
| JP | 02125775 | A | * | 5/1990 |
| JP | 03036122 | A | * | 2/1991 |
| JP | 04066418 | A | * | 3/1992 |
| JP | 04219244 | A | * | 8/1992 |
| JP | 06127705 | A | * | 5/1994 |
| JP | 06127791 | A | * | 5/1994 |
| JP | 06191110 | A | * | 7/1994 |

* cited by examiner

MEDIUM TRAY AND IMAGE RECORDING APPARATUS USING THE SAME

BACKGROUND OF THE INVENTION

1. Field of the Invention

The present invention relates to a medium supporting structure of a medium tray for an image recording apparatus.

2. Description of the Related Art

An image recording apparatus is provided with a medium tray projecting from a face of the apparatus and a member for loading and supporting record media on the medium tray so as to feed the media to a medium feed section provided at a side of the image recording apparatus. The media loaded in the medium tray are fed to the image recording apparatus one by one.

However, in the image recording apparatus for handling a medium longer than a standard medium, most of the entire length of the long medium is required to be supported. Consequently, the length of the medium tray projecting from the side face of the apparatus becomes so great that the apparatus requires a large space for installation.

SUMMARY OF THE INVENTION

Accordingly, it is an object of the present invention to provide a medium tray capable of loading and supporting a long medium without making the tray lengthy.

In order to achieve the above object, according to the invention, the medium tray comprises a medium receiving section connected to the medium feed section of the image recording apparatus and loading a medium, and a medium supporting section changing the angle of the rear portion of medium loaded in the medium receiving section for supporting the medium.

DESCRIPTION OF THE PREFERRED EMBODIMENT

First Embodiment

Figure 1:
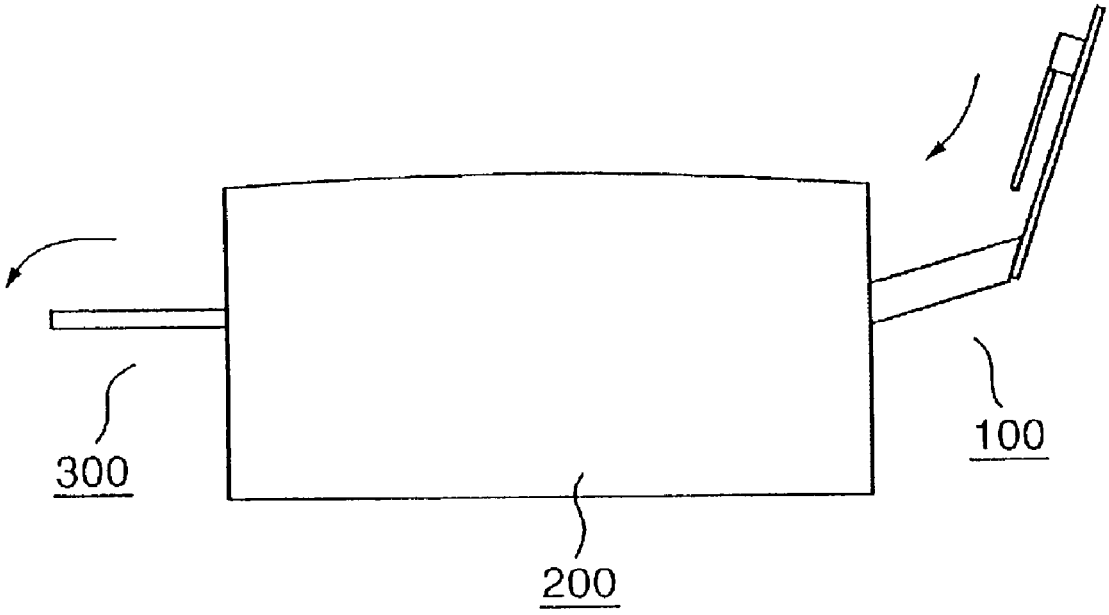
FIG. 1 is a side view of an image recording apparatus according to the first embodiment of the present invention.

In FIG. 1, an image recording apparatus according to the first embodiment of the invention comprises a main body 200, a medium feeding section 100 provided at an end thereof for feeding media into the apparatus, and a medium outputting section 300 at the other end thereof for outputting recorded media.

Figure 2:
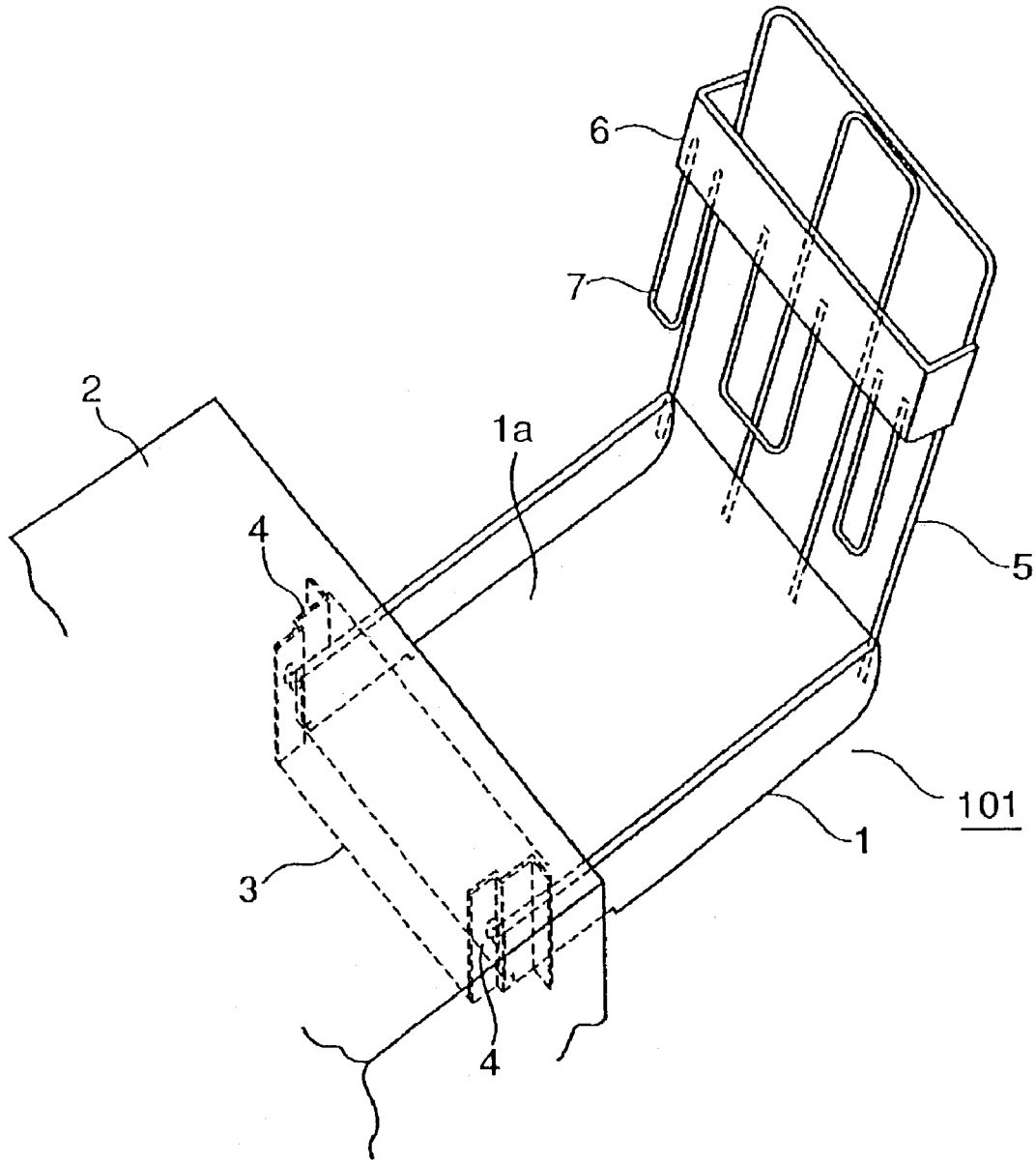
FIG. 2 is a perspective view of a medium tray according to the first embodiment of the present invention.

In FIG. 2, the medium feeding section 100 is provided with a medium tray 101 projecting from the face of the main body of the image recording apparatus 200 and composed of a medium support 1, a guide 5, a band 6, and a plurality of guards 7. The medium support 1 is made of a synthetic resin, box-shaped, and connected to the guide 5 at an end thereof. The guide 5 is made by assembling metallic shafts and fixed to a support face 1*a* of the medium support 1 at a predetermined angle. The predetermined angle is set at substantially right angles with respect to the supporting face 1*a*. The band 6 is made of a synthetic resin and attached to the guide 5 such that the space between the band 6 and the guide 5 has a size slightly greater than the thickness of the maximum number of media set in the medium feeding section 100. The guards 7 extend downwardly from the band 6 in parallel to the guide 5.

Figure 3:
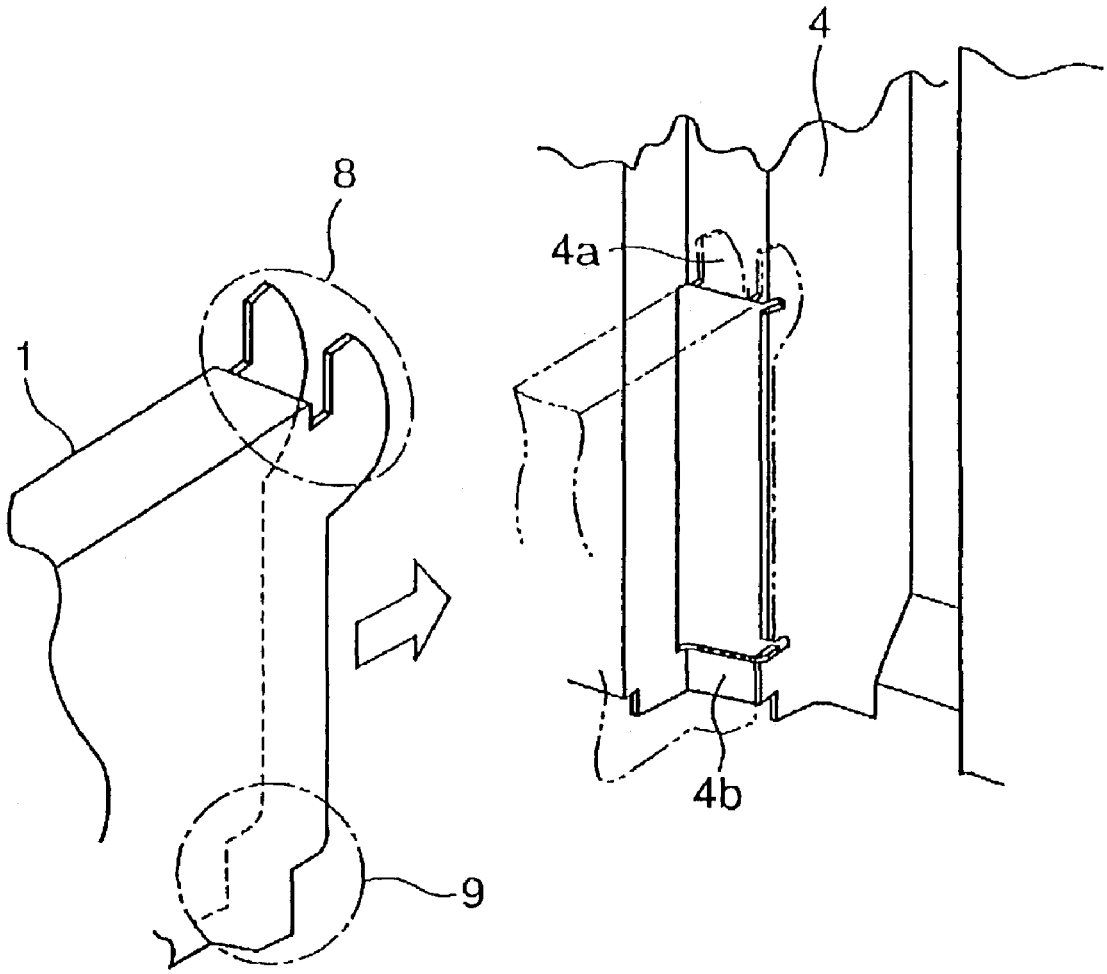
FIG. 3 is a perspective view of a fixing section of the medium tray of FIG. 2.

In FIG. 3, a fixing section for fixing the medium tray 101 to the image recording apparatus is provided with a pair of upper and lower engaging portions 8 and 9 at both sides of the tray 101 in the widthwise direction of the tray 101. The medium feeding section 100 of the image recording apparatus 200 is provided with a medium absorber 3. Frames 4 disposed on both sides of the absorber 3 are provided with upper and lower engaged portions 4*a* and 4*b* which engage with the upper and lower engaging portions 8 and 9 of the tray 101, respectively. The frames 4 are made of a sheet metal forming the main body 200 of the image recording apparatus.

The medium tray 101 is fixed to the main body 200 by engaging the upper and lower engaging portions 8 and 9 of the tray 101 with the upper and lower engaged portions 4*a* and 4*b* of the frames 4, respectively. In this embodiment, the medium support 1 of the tray 101 is fixed to the main body 200 at a predetermined angle so that media are fed efficiently.

Figure 4:
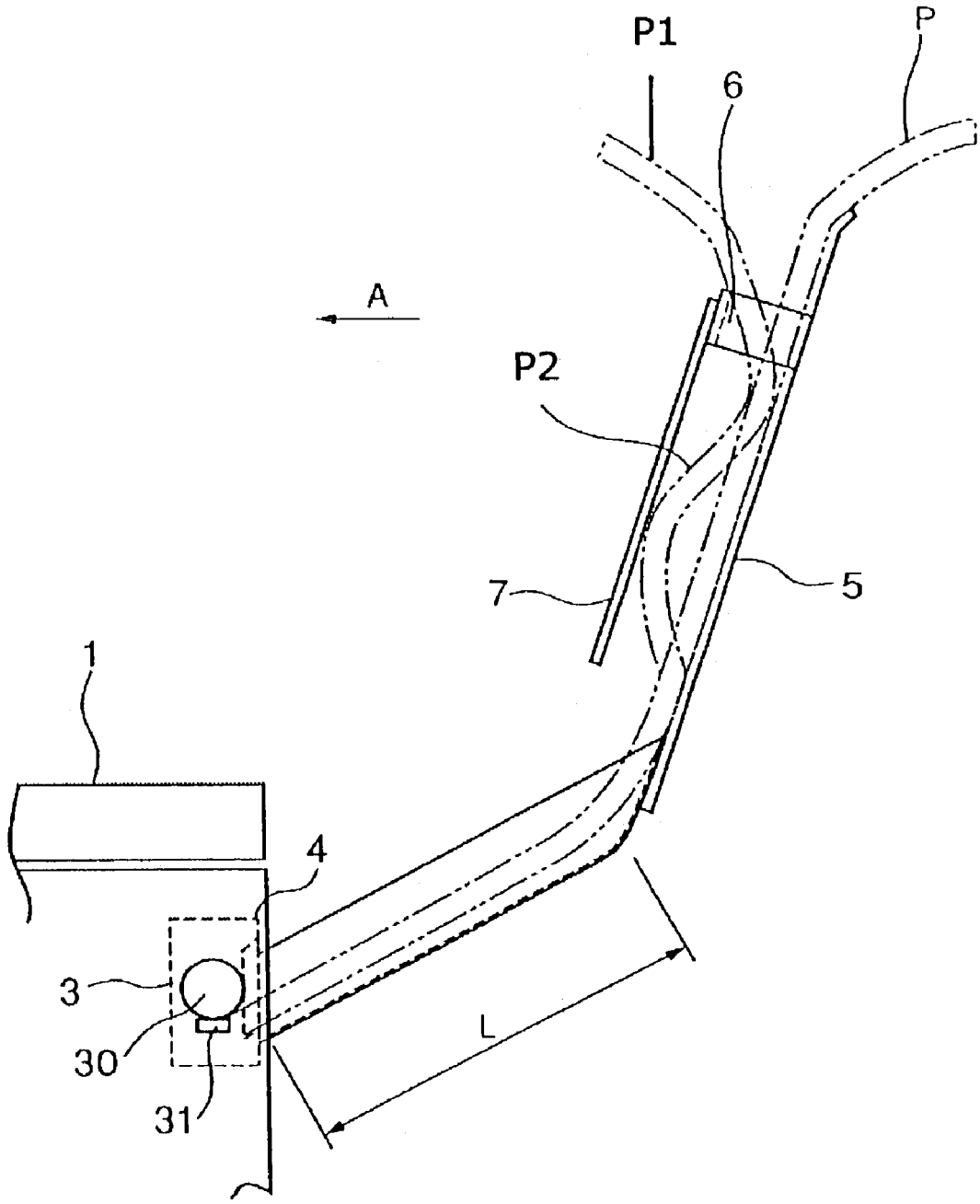
FIG. 4 is a side view of the medium tray of FIG. 2, wherein a long medium is set at the medium tray.

In FIG. 4, the medium absorber 3 comprises a feeding roller 30 which feeds medium one by one and a separating member 31 which is biased so that the first one of the media is fed by friction. A lengthy medium P is set on the medium tray 101 such that it is brought into contact with the feeding roller 30. The medium support 1 of the medium tray 101 is flat and has a length L. The front portion of the lengthy medium P is loaded along the medium support 1. In this embodiment, the length L is set at 300 mm. Since the front portion of the lengthy medium P is loaded on the plane, the contact angle of the front portion of the lengthy medium P is kept stable with respect to the feeding roller 30 and the separating member 31 so that the jamming of a medium at the medium absorber 3 is prevented. If the length L is 100 mm or more, the medium feeding is stable. The length L of lengthy medium P can be 900-1,200 mm.

The rear portion of the lengthy medium P, which extends upwardly from the front portion thereof by more than 600 mm, is surrounded by the guide 5, band 6, and guard 7. Consequently, it is prevented that a rear portion P1 of the lengthy medium P completely falls down in a direction A or a middle portion P2 of the lengthy medium P warps in the direction A so that the lengthy medium P does not come off the place. Also, the lengthy medium P can be loaded at the medium tray 101 without being disordered even when the guide 5 is attached in upright stance at an angle more than 45 degrees. Accordingly, the medium tray 101 does not project to a large extent from the image recording apparatus to accommodate the lengthy medium P.

The operation in the first embodiment will now be described. When the image recording apparatus starts a printing job, the feeding roller 30 starts rotation so that one uppermost sheet of lengthy medium P loaded in the medium tray 101 is fed. At this point, the uppermost sheet and the next sheet under the uppermost sheet are separated by the separating member 31 so that only the uppermost sheet is absorbed or taken into the image recording apparatus. An images is printed on the absorbed lengthy medium by an image forming section (not illustrated) and the printed medium is outputted from the medium outputting section 300.

As described above, in the medium tray according to the first embodiment of the invention, the medium support projecting from the image recording apparatus is provided with the upwardly standing guide, which is provided with supporting members, such as the band and the medium guard, such that they surround the medium. Consequently, it is possible to decrease the area where the lengthy medium is set without large absorbing angles of the lengthy medium.

In addition, since the rear portion of the lengthy medium extends upwardly and tends to slip down by its weight, the front portion of the medium is pushed against the feeding roller 30. Accordingly, the front portion is brought into firm contact with the roller 30.

Second Embodiment

In the second embodiment, the same reference numbers are used for elements identical with or similar to those used in the first embodiment and detailed description therefor is omitted.

Figure 5:
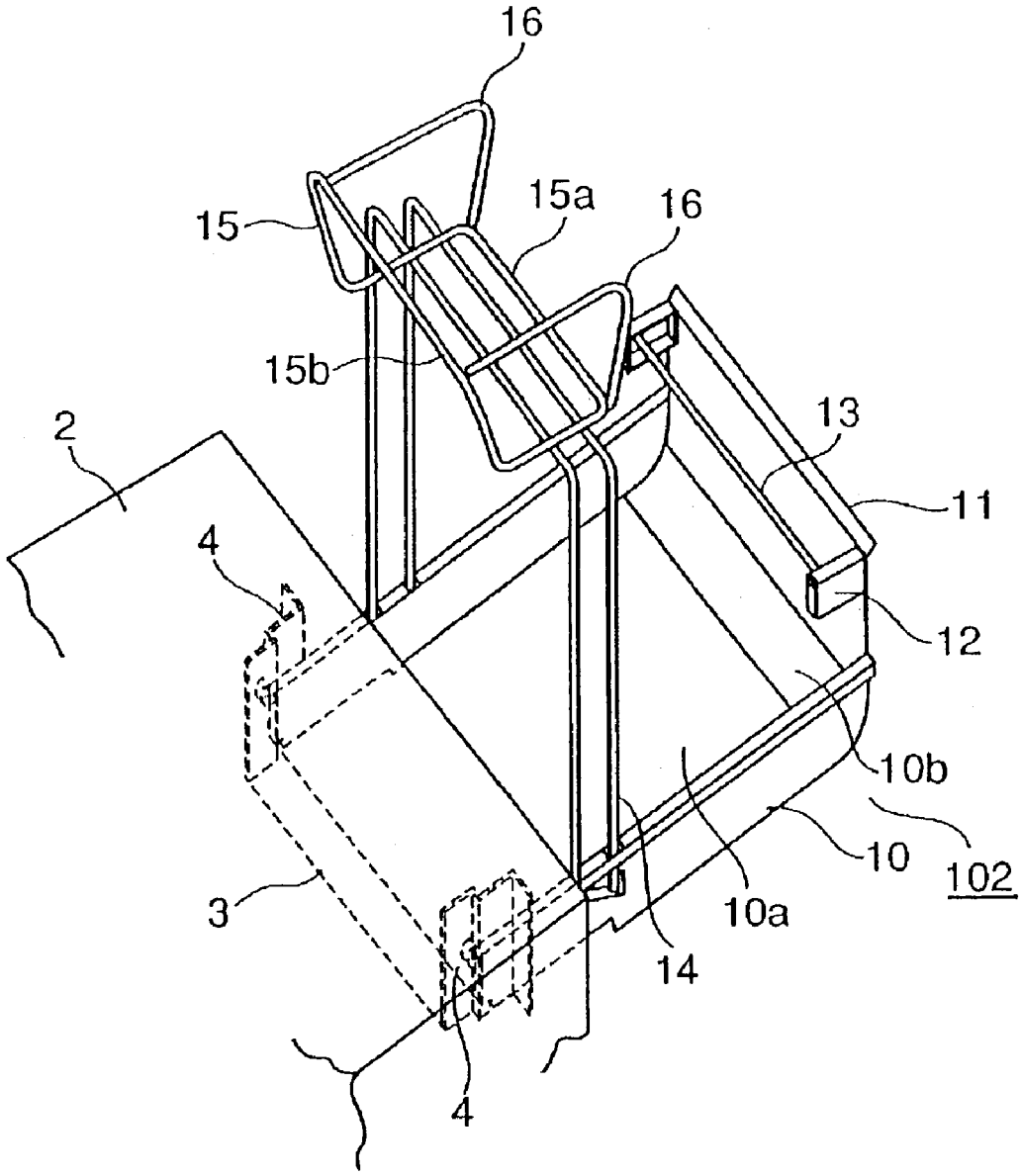
FIG. 5 is a perspective view of a medium tray according to the second embodiment of the present invention.

In FIG. 5, a medium tray 102 comprises a medium support 10, a guide 11, a medium folding shaft 13, a side frame 14, a top frame 15, and a top guide 16. The medium support 10 is box-shaped by bending a metal sheet and has a plane section 10*a* and a curved section 10*b* extending rearwardly from the plane section 10*a*. The guide 11 extends upwardly from the curved section 10*b* and a supporter 12 is provided at an upper portion of the guide 11 for supporting the medium folding shaft 13. The medium folding shaft 13 is made of a metal shaft and supported by the supporter 12 such that the space between the guide 11 and the shaft 13 has a size slightly greater than the thickness of the maximum allowable number of media.

The side frame 14 is made of a metal shaft and extends upwardly from both sides of the medium support 10 and then it strides across the medium support 10. The top frame 15 is made of a metal shaft and joined to an upper portion of the side frame 14. The top frame 15 includes supporters 15*a* and 15*b* for supporting the rear portion of the lengthy medium P. The top guide 16 is made of a metal shaft and joined to sides of the top frame 15 for guiding the rear portion of the lengthy medium P.

Figure 6:
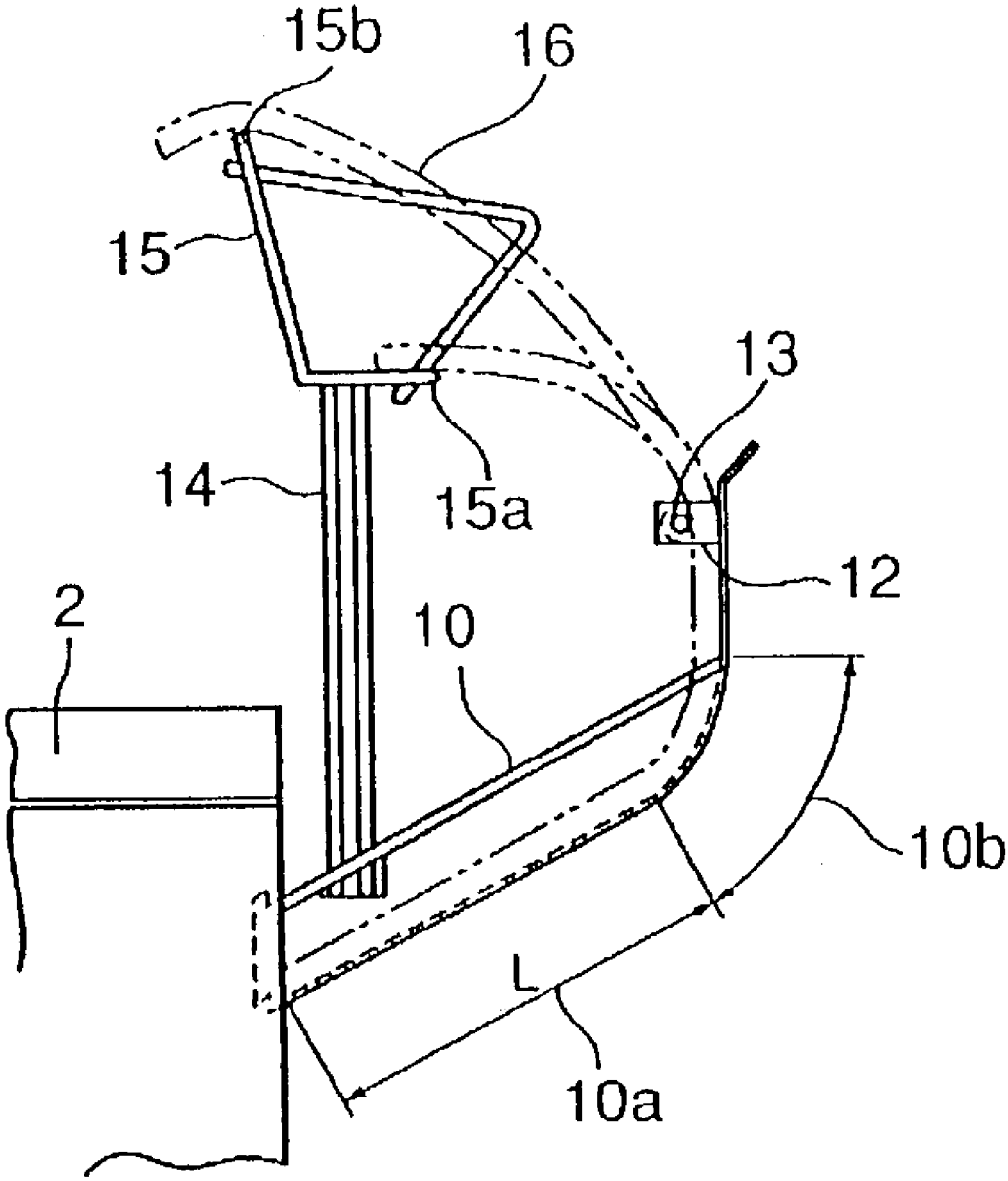
FIG. 6 is a side view of the medium tray of FIG. 5, wherein a long medium is set at the medium tray.

In FIG. 6, the back face of the lengthy medium P is supported by the plane section 10*a* and curved section l0*b* of the medium support 10 and guide 11. The front face of the lengthy medium P is supported by and folded at the medium folding shaft 13 and the rear end of the lengthy medium P is supported by the supporters 15*a* and 15*b* of the top frame 15 with the front face thereof facing down. In this embodiment, it is designed that the rear end of the lengthy medium P having a length of 900 mm is supported by the supporter l5*a* and the rear end of the lengthy medium having a length of 1,200 mm is supported by the supporter 15*b*. The rear side of the medium is restricted by the top guide 16 in the widthwise direction of the medium. The curvature of the curved section l0*b* and the height of the guide 11 are determined such that the lengthy medium is not folded forcibly.

The operation in the second embodiment will now be described. When the image recording apparatus starts a printing job, the feeding roller 30 starts rotation so that uppermost sheet of lengthy medium P loaded in the medium tray 102 is fed. The rear end of the sheet is fed through the supporter 15*a* or 15*b*, folded at the medium folding shaft 13, and transported along the guide 11 and the curved and plane sections 10*b* and 10*a* of the medium support 10. At this point, the uppermost sheet and the next sheet under the uppermost sheet are separated by the separating member 31 so that only the uppermost sheet is absorbed into the image recording apparatus. An image is printed on the absorbed lengthy medium by an image forming section (not illustrated) and the printed medium is outputted from the medium outputting section 300.

As described above, in the medium tray according to the first embodiment of the invention, the medium support projecting from the image recording apparatus is provided with the supporters for supporting the rear end of the folded lengthy medium above the medium support. Consequently, it is possible to reduce the area where the lengthy medium is set without upright absorbing angles of the lengthy medium. Accordingly, the space for installing the image recording apparatus is reduced.

Third Embodiment

In the third embodiment, the same reference numbers are used for elements identical with or similar to those used in the first or second embodiment and detailed description therefor is omitted.

Figure 7:
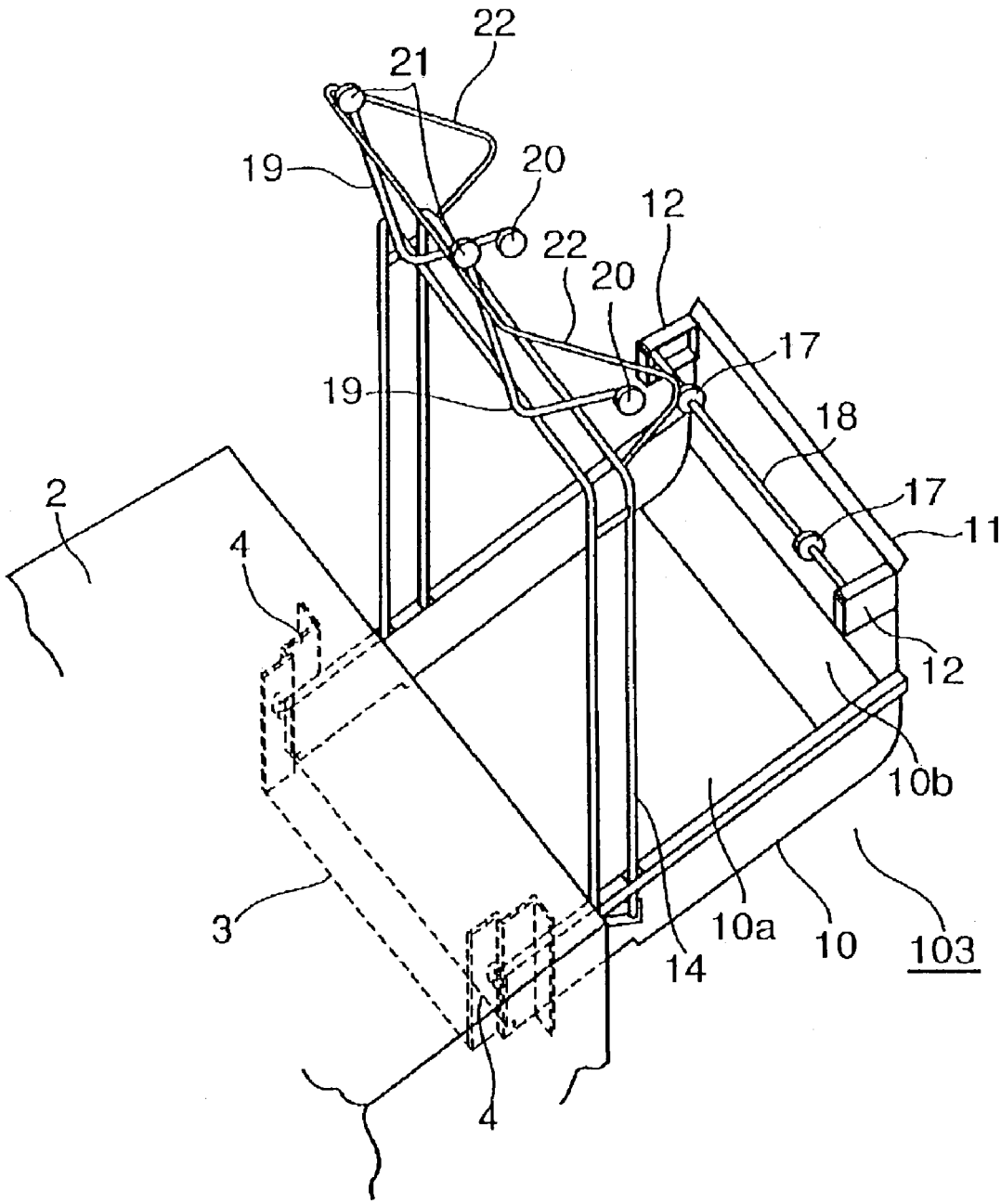
FIG. 7 is a perspective view of a medium tray according to the third embodiment of the present invention.

In FIG. 7, a medium tray 103 according to the third embodiment comprises a medium tray 10, guide 11, medium folding rollers 17, shaft 18, side frame 14, top frame 19, medium supporting rollers 20 and 21 for supporting the rear portion of the medium, and top guide 22. A supporter 12 is provided at an upper portion of the guide 11 for supporting the shaft 18. The medium folding rollers 17 are rotatably provided at the shaft 18 for folding and supporting the lengthy medium P. The shaft 18 is supported by the supporter 12 such that the space between the folding rollers 17 and the guide 11 has a size slightly greater than the thickness of the maximum allowable number of the medium.

The top frame 19 is made of a metal shaft and joined to an upper portion of the side frame 14. The medium supporting rollers 20 and 21 are rotatably provided at the top frame 19 for supporting the rear end of the lengthy medium P. The top guide 22 is made of a metal shaft and joined to the side frame 14 for guiding the rear portion of the lengthy medium P.

Figure 8:
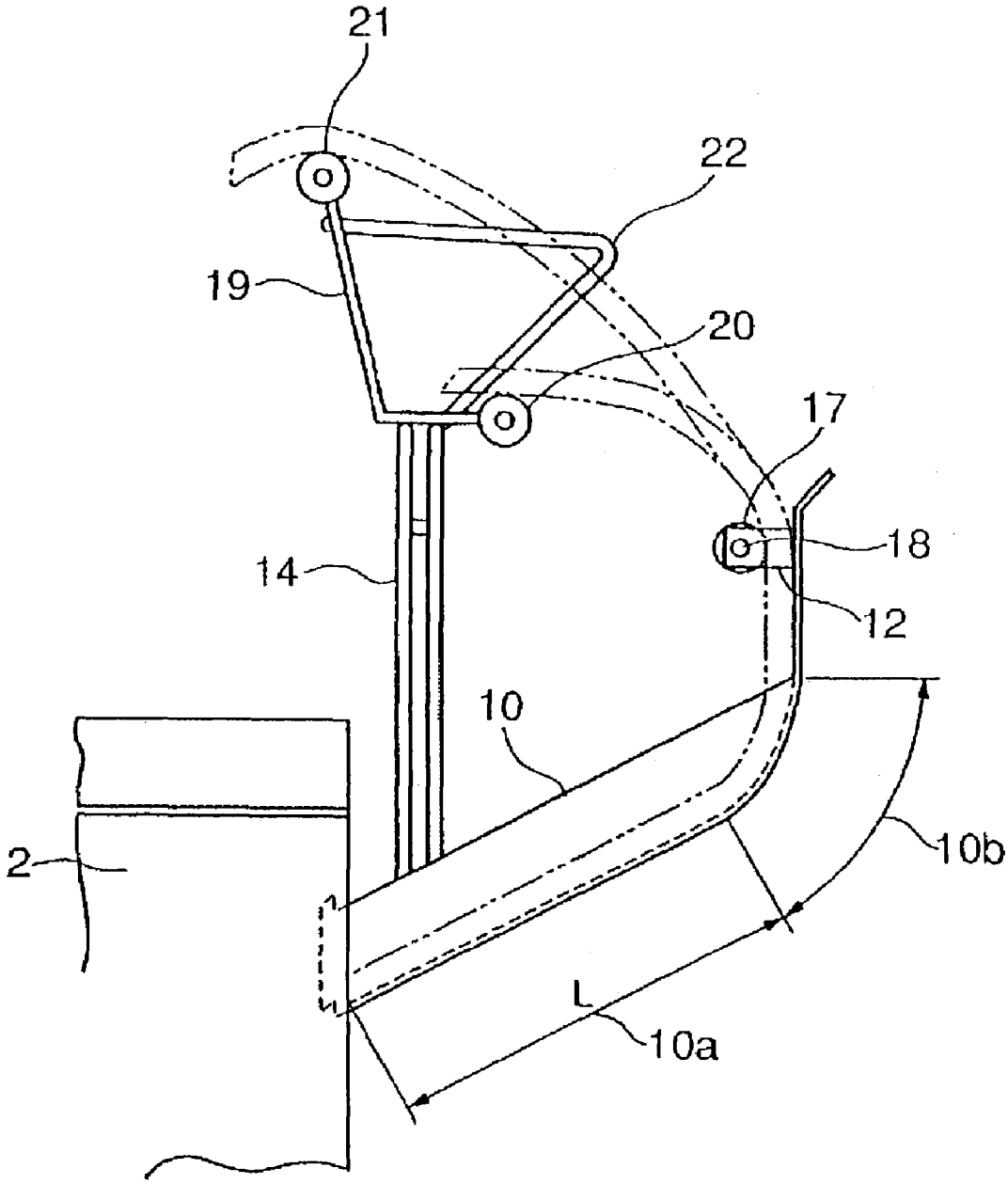
FIG. 8 is a side view of the medium tray of FIG. 7, wherein a long medium is set at the medium tray.

In FIG. 8, the back face of the lengthy medium P is supported by the plane and curved sections 10*a* and 10*b* of the medium support 10 and the guide 11. The front face of the lengthy medium P is supported by and folded at the medium folding rollers 17 and the rear end of the lengthy medium P is supported by the medium supporting roller 20 or 21 of the top frame 15 with the front face thereof facing down. In this embodiment, it is designed that the rear end of the lengthy medium P having a length of 900 mm is supported by the supporting roller 20 and the rear end of the lengthy medium having a length of 1,200 mm is supported by the supporting roller 21. The rear side of the medium is restricted by the top guide 22 in the widthwise direction of the medium.

The operation in the third embodiment will now be described. When the image recording apparatus starts a printing job, the feeding roller 30 starts rotation so that uppermost sheet of lengthy medium P loaded in the medium tray 103 is fed. At this point, the uppermost sheet and the next sheet under the uppermost sheet are separated by the separating member 31 so that only the uppermost sheet is absorbed into the image recording apparatus.

The sheet is folded at the medium folding rollers 17 and supported by the supporting roller 20 or 21 with the front face thereof facing down so that the sheet is pressed against the supporting rollers 17 by the weight of loaded medium. However, since the medium folding and supporting rollers 17, 20, and 21 are rotatably provided, when the uppermost sheet is transported, the respective rollers rotate so that the pressure does not interfere with the transportation of the sheet. An image is printed on the absorbed lengthy medium by an image forming section (not illustrated) and the printed medium is outputted from the medium outputting section 300.

As described above, according to the third embodiment, in addition to the effects of the second embodiment, there is no interference in the transporting of the medium because the rotatable members are provided at positions where the medium is folded and supported.

In the second and third embodiments, the rear portion of the folded medium is supported above the medium support 10. However, the rear portion may extend up to the above of the image recording apparatus 200 so that it is supported above the image recording apparatus 200. Also, in the embodiments, a plurality of the medium supporting members for supporting the rear portion of the folded medium are provided at predetermined positions in accordance with the length of used medium. However, the position of the medium supporting member may be adjusted by providing means for adjusting the height of the side frame 14 so that only a single medium supporting member correspond to different heights of media.

According to the first, second, and third embodiments, it is possible to load the lengthy medium without large projection area of the medium tray. However, an output tray projecting from the main body is required at the medium outputting section 300 to stack outputted lengthy medium. The solutions for that problem will now be described below.

Fourth Embodiment

Figure 9:
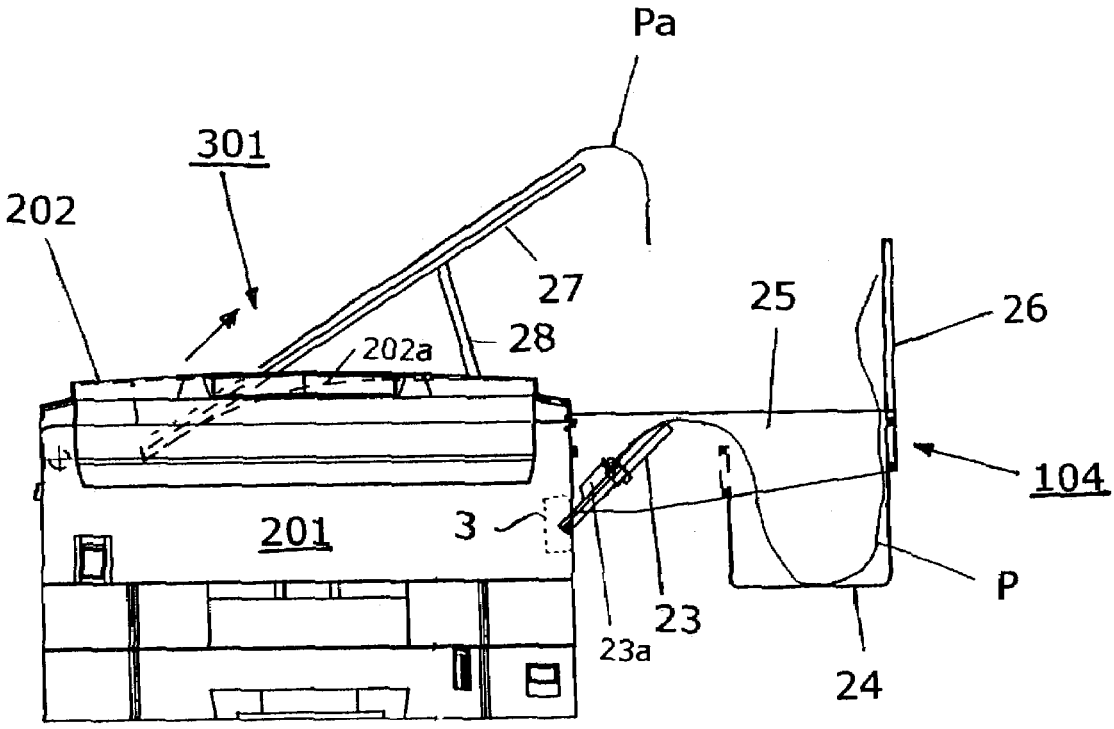
FIG. 9 is a side view of an image recording apparatus according to the fourth embodiment of the present invention.

In the fourth embodiment, the same reference numbers are used for elements identical with or similar to those used in the first or second embodiment and detailed description therefor is omitted. In FIG. 9, an image recording apparatus 201 comprises a medium tray 104 at medium feeding section provided at the side thereof and an access cover 202 at the top thereof, which is opened and closed for replacement or repair of consumption articles inside the image recording apparatus 201. An medium outputting section 301 is provided on the access cover 202 for outputting the medium on which an image is recorded.

The medium tray 104 comprises a medium receiver 23, a lengthy medium receiver 24, a supporter 25, and a guide 26 for guiding the rear portion of the lengthy medium. The medium receiver 23 is attached to the image recording apparatus 201 at a predetermined angle so that the medium is supplied efficiently. A guiding section 23*a* is provided at sides of the medium receiver 23 to guide the medium in the widthwise direction of the medium so that the medium is not fed obliquely when it is supplied to the apparatus 201. The lengthy medium receiver 24 is supported by the supporter 25 so as to be attached to the apparatus 201. The lengthy medium receiver 24 is U-shaped so that it receives the medium which is folded downwardly at the middle or rear portion thereof. Consequently, it is possible to set the lengthy medium P without enlarging the area projecting from the apparatus body, thus reducing the space for the installation of the apparatus. The guide 26 restricts the rear end of the medium so that the rear end does not hang down from the rear side of the lengthy medium receiver 24. Also, as shown in the first embodiment, the band 6 and guard 7 may be provided at the guide 26 to prevent the rear end of the lengthy medium P from falling down.

After an image is recorded on the medium inside the apparatus, the medium is reversed and transported, and then outputted to the above of the apparatus by the medium outputting section 301. In this embodiment, a lengthy medium stacker 27 is provided to stack the outputted recorded medium Pa. The lengthy stacker 27 is supported by a lengthy stacker supporter 28 such that it stands from top face of the main body of the apparatus toward the medium tray 104 at a predetermined angle. Consequently, it is possible to provide the lengthy medium stacker 27 without increasing the area projecting from the apparatus body, thus reducing the space for the installation of the apparatus.

The operation of outputting the medium Pa after recording will be described below. The medium Pa is stacked on the slope of the lengthy medium stacker 27. A plurality of the media Pa are stacked in the same way one upon another.. The front end of the medium Pa is transported above the medium tray 104 so that the recorded medium Pa is not absorbed by the medium absorber 3 again.

As described above, according to the fourth embodiment, it is possible to provide the lengthy medium stacker 27 for stacking the lengthy medium without increasing the area projecting from the apparatus body and reducing the space for the installation of the apparatus. The lengthy medium receiver 24, guide 26, supporter 24, and lengthy medium stacker 27 are detachably provided so that when a medium having a standard size instead of the lengthy medium is used, these members are not attached and the medium is set in the medium receiver 23. The medium after recording is stacked in a standard stacker 202*a* provided on the access cover 202. The lengthy medium stacker 27 is removed when the access cover 202 is required to be opened.

Fifth Embodiment

In the fifth embodiment, the same reference numbers are used for elements identical with or similar to those used in the first or second embodiment and detailed description therefor is omitted.

Figure 10:
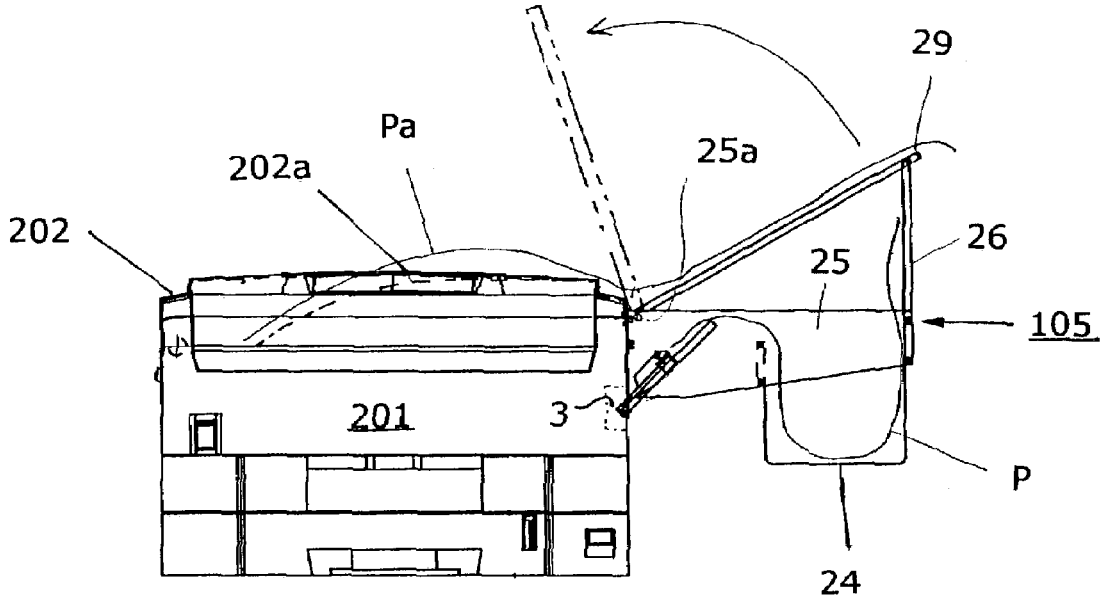
FIG. 10 is a side view of an image recording apparatus according to the fifth embodiment of the present invention.

As shown in FIG. 10, the lengthy medium stacker 27 according to the fourth embodiment is replaced with a lengthy stack guide 29. The lengthy stack guide 29 is rotatable about a fulcrum 25*a* provided on the supporter 25 of the medium tray 105 and the front end thereof abuts against the top of the guide 26 such that the lengthy stack guide 29 covers the medium tray 105. When the lengthy medium P is set in the medium tray 105, the lengthy stack guide 29 is rotated as shown by a two-dot chain line so that the lengthy medium P is inserted from the open space.

The lengthy medium Pa after recording is outputted in the stacker 202*a* on the access cover 202 and further transported toward the medium tray 105. Since the lengthy stack guide 29 is provided above the medium tray 105, the front portion of the lengthy medium is stacked on the lengthy stack guide 29. Namely, the lengthy medium Pa is stacked on both the stacker 202*a* and the lengthy stack guide 29. A plurality of the lengthy medium Pa are stacked in the same way one upon another. The medium feeding section is covered by the lengthy stack guide 29 so that the medium Pa is not absorbed into the medium absorber 3 again.

As described above, according to the fifth embodiment, since the lengthy stack guide 29 is provided above the medium feeding section, it is possible to set and stack the lengthy medium without increasing the area projecting from the apparatus body thereby reducing the space for installation of the apparatus.

Sixth Embodiment

Figure 11:
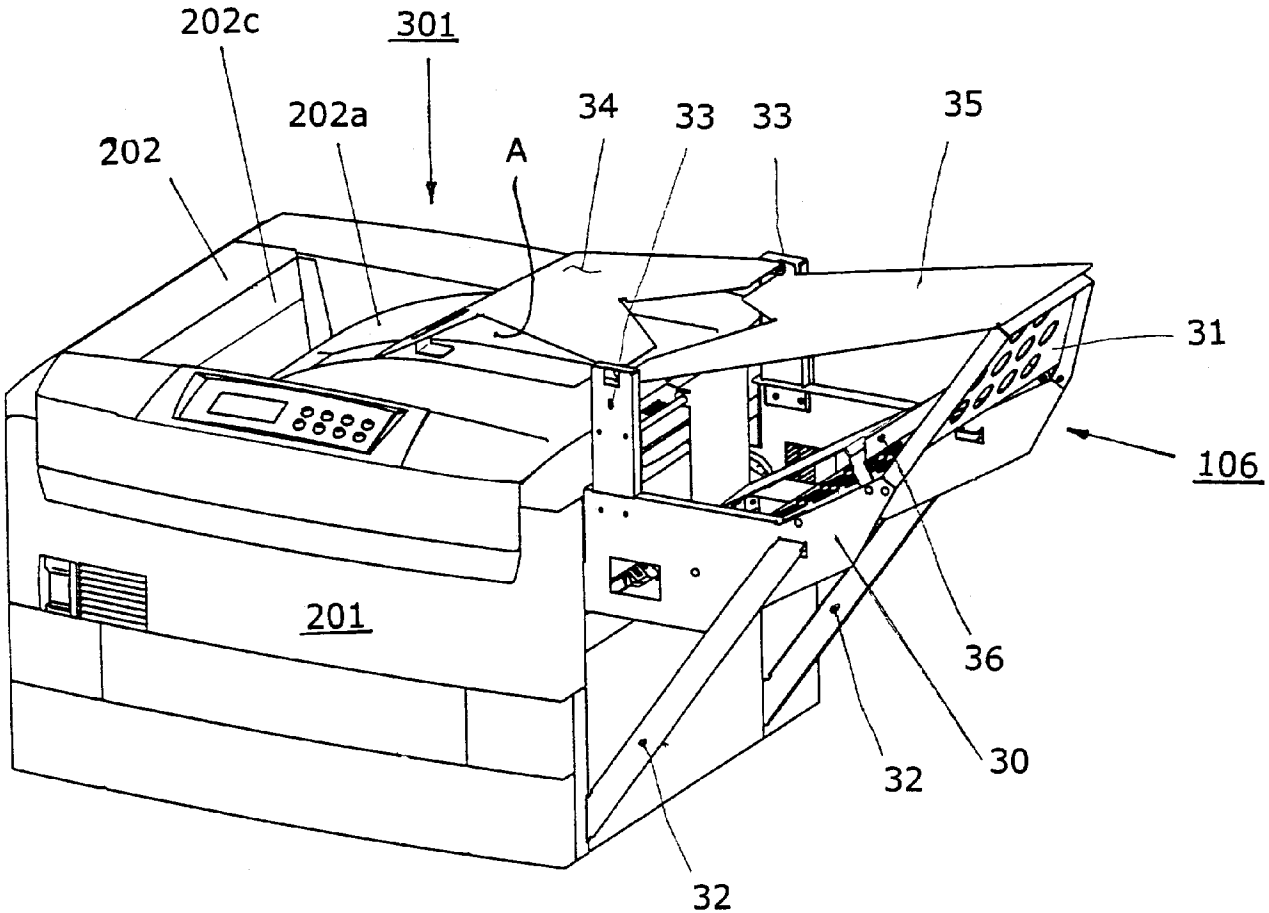
FIG. 11 is a perspective view of an image recording apparatus according to the sixth embodiment of the present invention.

In the sixth embodiment, the same reference numbers are used for elements identical with or similar to those used in the first or second embodiment and detailed description therefor is omitted. In FIG. 11, a medium tray 106 is provided in the medium feeding section at a side of the image recording apparatus 201 in order to set the length medium.

The medium tray 106 comprises a medium receiver 30, a guide 31 for guiding the rear portion of the medium, a pair of supporters 32, a pair of upper guide supporters 33, an upper guide 34 above the access cover 202 (access cove upper guide 34), a tray upper guide 35 above the medium tray 106 (tray upper guide), and a medium presser 36. The medium receiver 30 is attached to the medium absorber in the same way as in the first embodiment and supported by the supporters 32. The guide 31 restricts the medium such that not only the rear portion of the medium set in the medium receiver 30 is folded but also the medium is not slipped off the medium tray 106.

The upper guide supporters 33 extend upwardly from both sides of the medium receiver 30 and rotatably support the access cover upper guide 34, tray upper guide 35, and medium presser 36. The access cover upper guide 34 provides a predetermined space A on the access cover 202 so that the medium Pa outputted from a medium output portion 202*c* is guided to the above of the medium tray 106. The tray upper guide 35 covers the medium tray 106 and forms a continuous medium transportation guide together with the access cover upper guide 34. The medium presser 36 presses the medium against the medium receiver 30 to hold the medium on the medium receiver 30.

Figure 12:
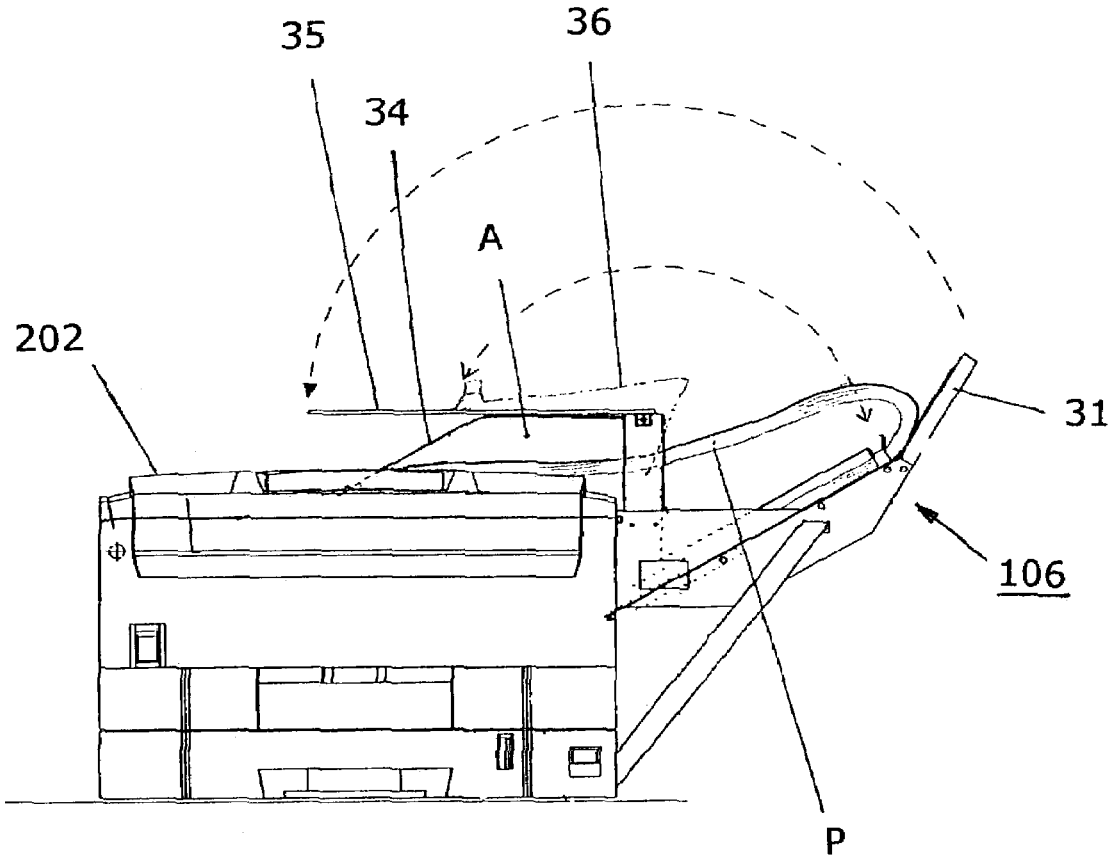
FIG. 12 is a side view of the image recording apparatus of FIG. 11, showing a setting operation of a long medium.

In FIG. 12, the access cover upper guide 34, tray upper guide 35, and medium presser 36 are all rotatable to the side of the access cover 202 to make a space above the medium receiver 30 so that the lengthy medium P is inserted into the medium tray 106. The front portion of the lengthy medium P is put on the medium receiver 30 and the medium presser 36 is rotated to the medium P so as to press the medium P against the medium receiver 30 so that the medium is absorbed in a stable manner along the medium receiver 30. The rear portion of the lengthy medium P is folded and inserted into the space between the access cover 202 and the access cover upper guide 34. Then, the tray upper guide 35 is rotated to abut against the top of the guide 31 and cover the medium tray 106.

Figure 13:
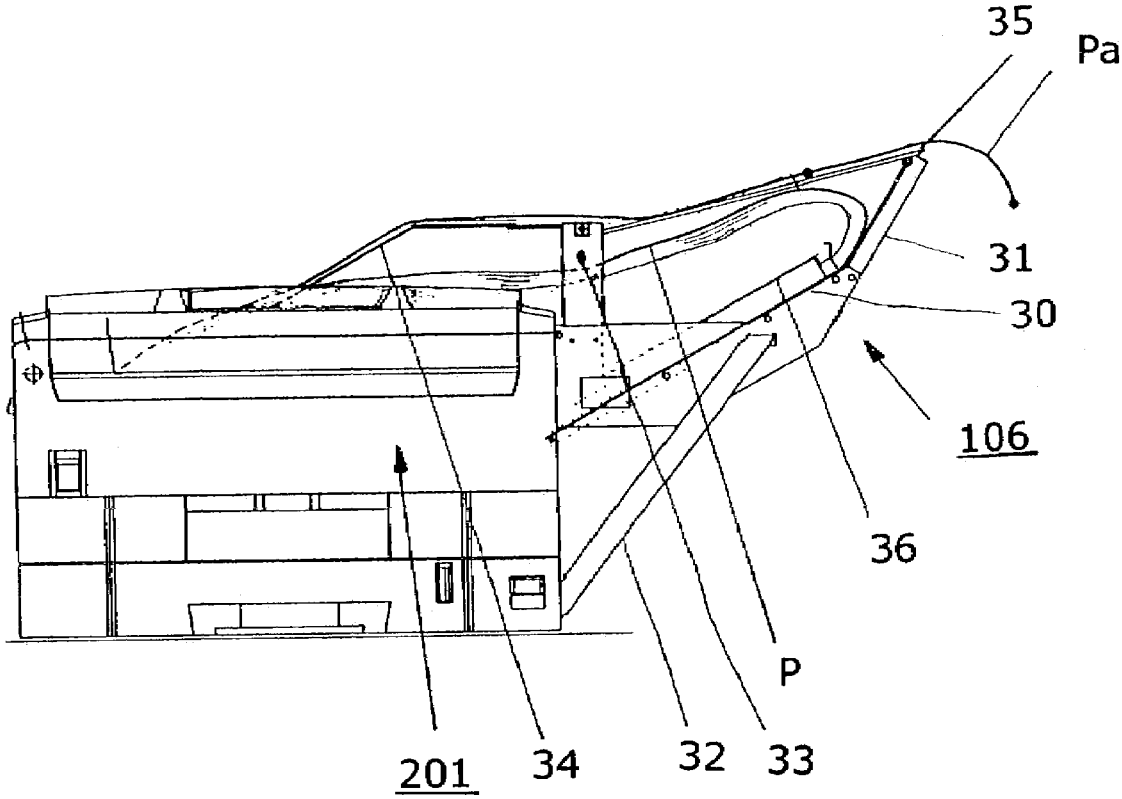
FIG. 13 is a side view of the image recording apparatus of FIG. 11, showing an outputting operation of a recorded medium.

In FIG. 13, the medium Pa after recording, which is outputted from the medium outputting portion 202*c*, is guided along the front faces of the stacker 202*a* and access cover upper guide 34 and transported onto the tray upper guide 35 to be stacked. A plurality of the media are stacked in the same way one upon another.

Figure 14:
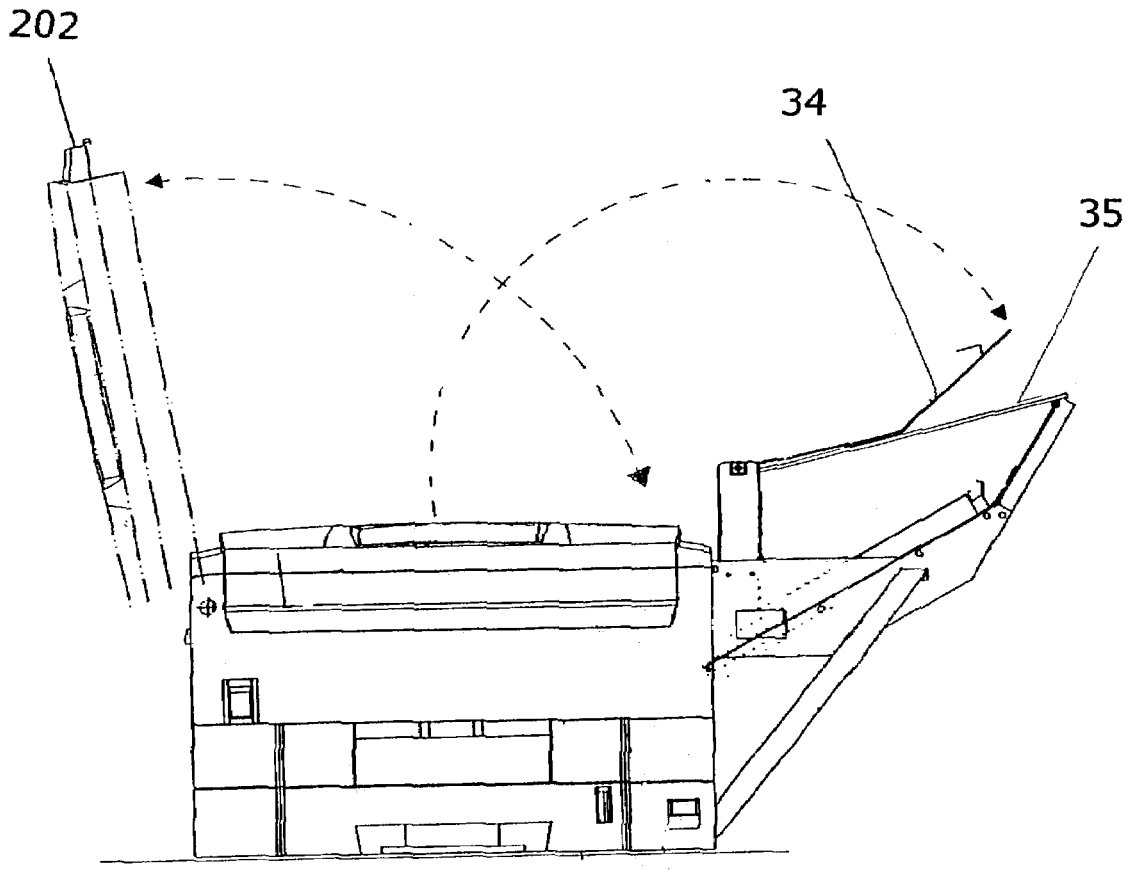
FIG. 14 is a side view of the image recording apparatus of FIG. 11, showing an opening/closing operation of an access cover.

As shown in FIG. 14, when a consumption article, such as toner cartridge, is replaced or repaired, the access cover 202 is opened. In order to open or close the access cover 202, the access cover upper guide 34 is rotated onto the tray upper guide 35 so that the space above the access cover 202 is opened.

As described above, according to the sixth embodiment, the lengthy medium is folded and the rear portion of the folded medium is positioned above the image recording apparatus so that the area of the medium tray projecting from the main body is reduced. Also, since the stacker for the medium after recording is provided above the main body and the medium tray, the stacker does not project from the main body, thus minimizing the space for installation of the apparatus.

Seventh Embodiment

Figure 15:
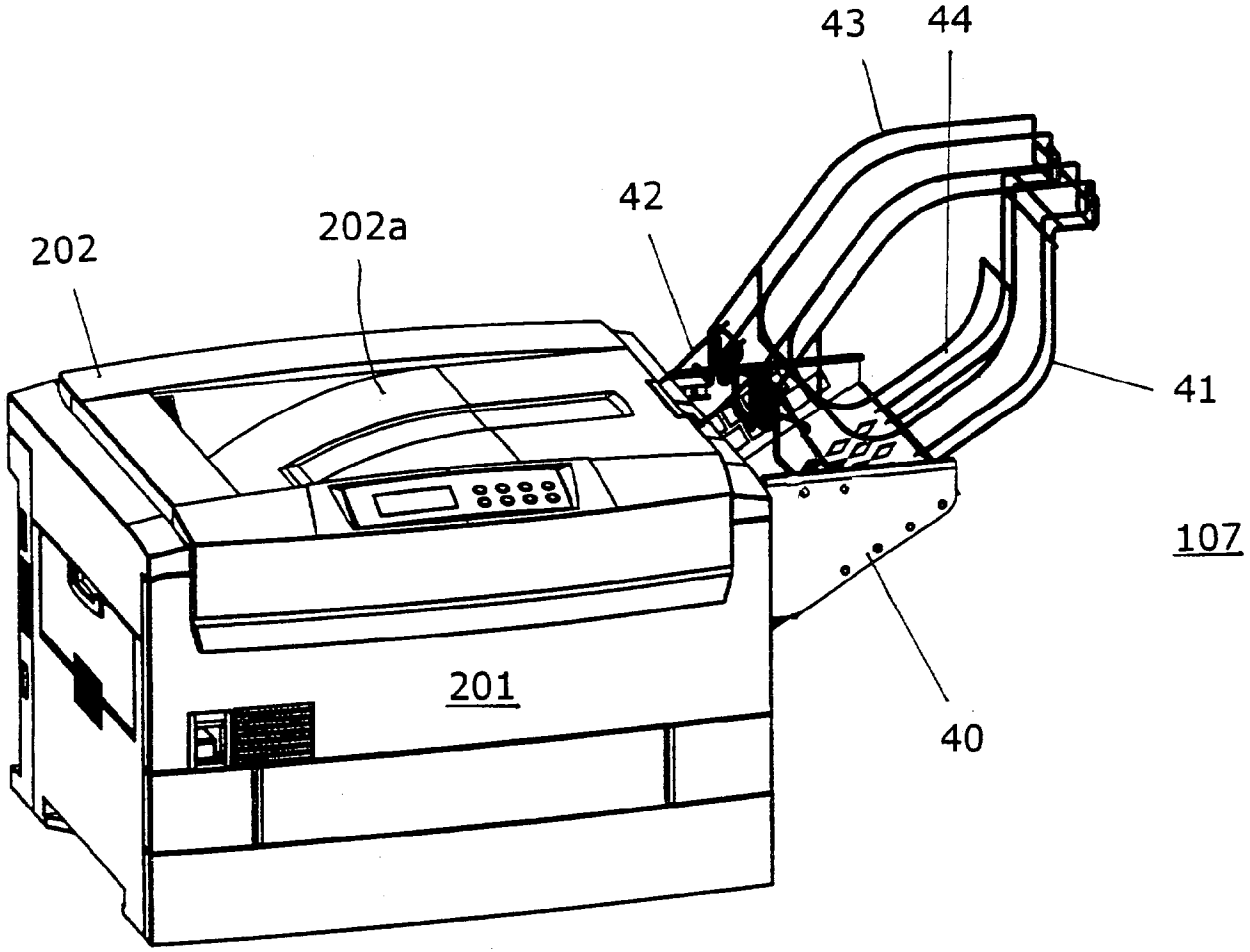
FIG. 15 is a perspective view of an image recording apparatus according to the seventh embodiment of the present invention.

In the seventh embodiment, the same reference numbers are used for elements identical with or similar to those used in the first or second embodiment and detailed description therefor is omitted. In FIG. 15, a medium tray 107 is provided at the medium feeding section on a side of the image recording apparatus 201 for setting the lengthy medium.

The medium tray 107 comprises a medium receiver 40, a guide 41 for guiding the rear portion of the medium, a first upper guide 42, a second upper guide 43, and a holding guide 44 for holding the rear portion of the medium. The medium receiver 40 is attached to the medium absorber in the same way as in the first embodiment. The guide 41 restricts the medium such that not only the rear portion of the medium set in the medium receiver 40 is folded but also the medium is not slipped off the medium tray 106.

The first upper guide 42 is rotatably supported at both sides of the medium receiver 40 and switches the position thereof from where it forms a continuous medium transportation guide with the stacker 202*a* and the second upper guide 43 to where it separates from the access cover 202. The second upper guide 43 is rotatably supported at both sides of the medium receiver 40 and switches the position thereof from where it covers above the medium tray 107 to where it opens the space above the medium receiver 40. The holding guide 44 is provided under the second upper guide 43 so that the rear portion of the lengthy medium P is rolled and held in the space surrounded by the second upper guide 43 and the holding guide 44. Each of the guide 41, first and second upper guides 42 and 43, and holding guide 44 is made of a metal shaft so as to make the medium tray less heavy.

Figure 16:
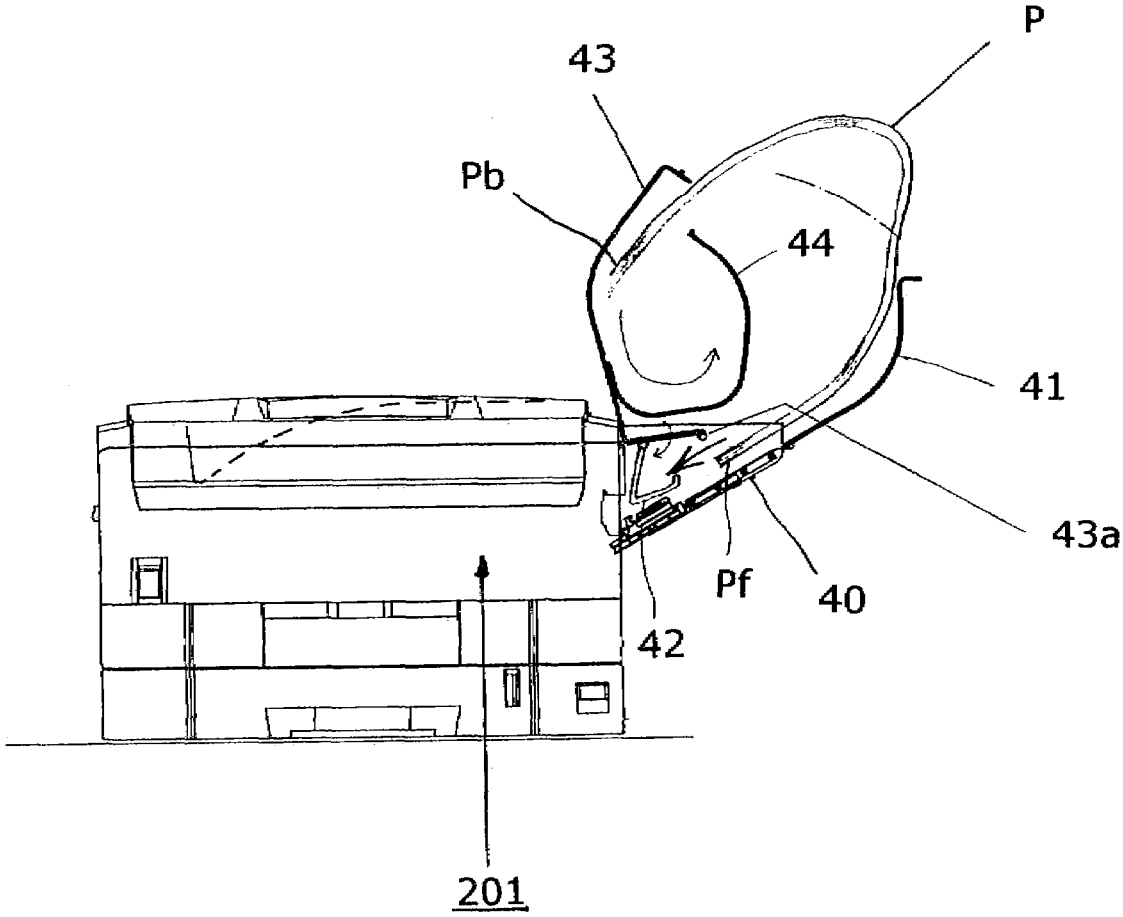
FIG. 16 is a side view of the image recording apparatus of FIG. 15, showing an outputting operation of a recorded medium.

In FIG. 16, in order to set the lengthy medium in the medium tray, the second upper guide 43 is rotated to a side of the access cover 202 with a rotation center 42*a* to make a space above the medium receiver 40. The front portion Pf of the lengthy medium P is put on the medium receiver 40 and rolled up along the inside curve of the space surrounded by the second upper guide 43 and the holding guide 44 to be inserted into the space. Then, the second upper guide 43 is rotated to abut against the top of the guide 41 and cover the medium tray 107. At this point, the rear portion of the lengthy medium P is further rolled up into the space.

Figure 17:
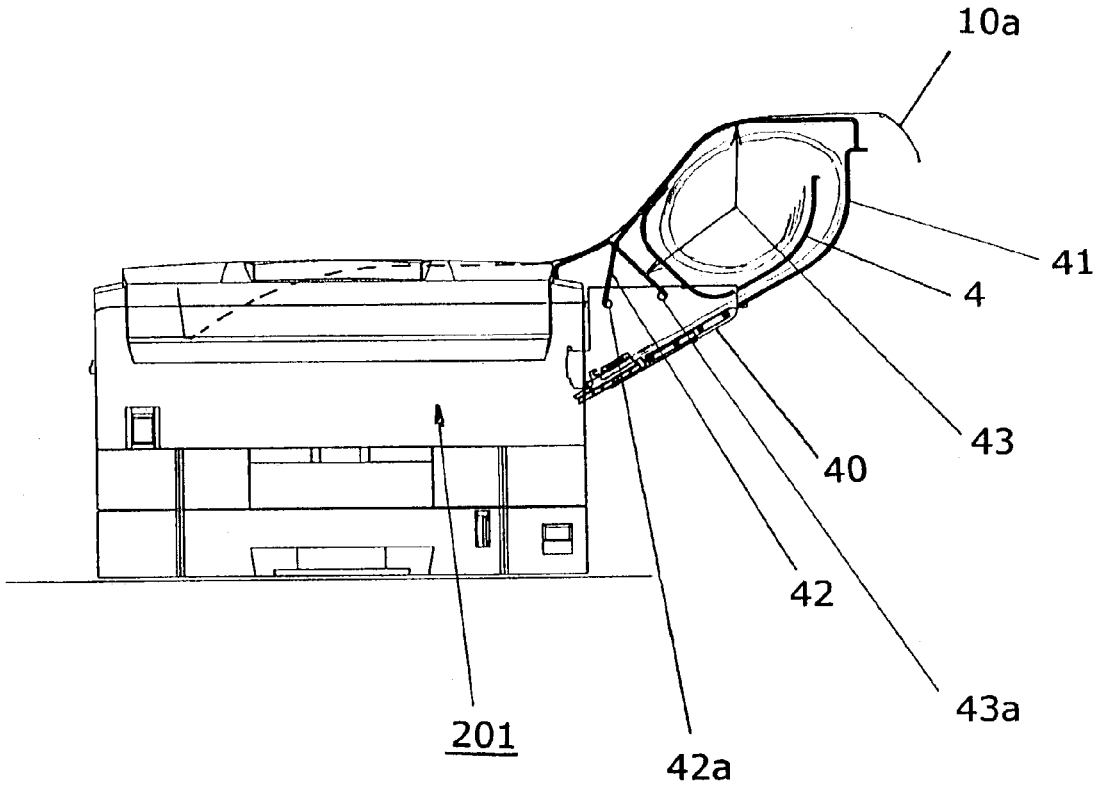
FIG. 17 is a side view of the image recording apparatus of FIG. 15, showing an opening/closing operation of an access cover.

In FIG. 17, the medium Pa after recording, which is outputted from the medium outputting portion 202*c*, is guided along the front faces of the stacker 202*a* and first upper guide 42 and transported onto the second upper guide 43 to be stacked. A plurality of the media are stacked in the same way one upon another.

Figure 18:
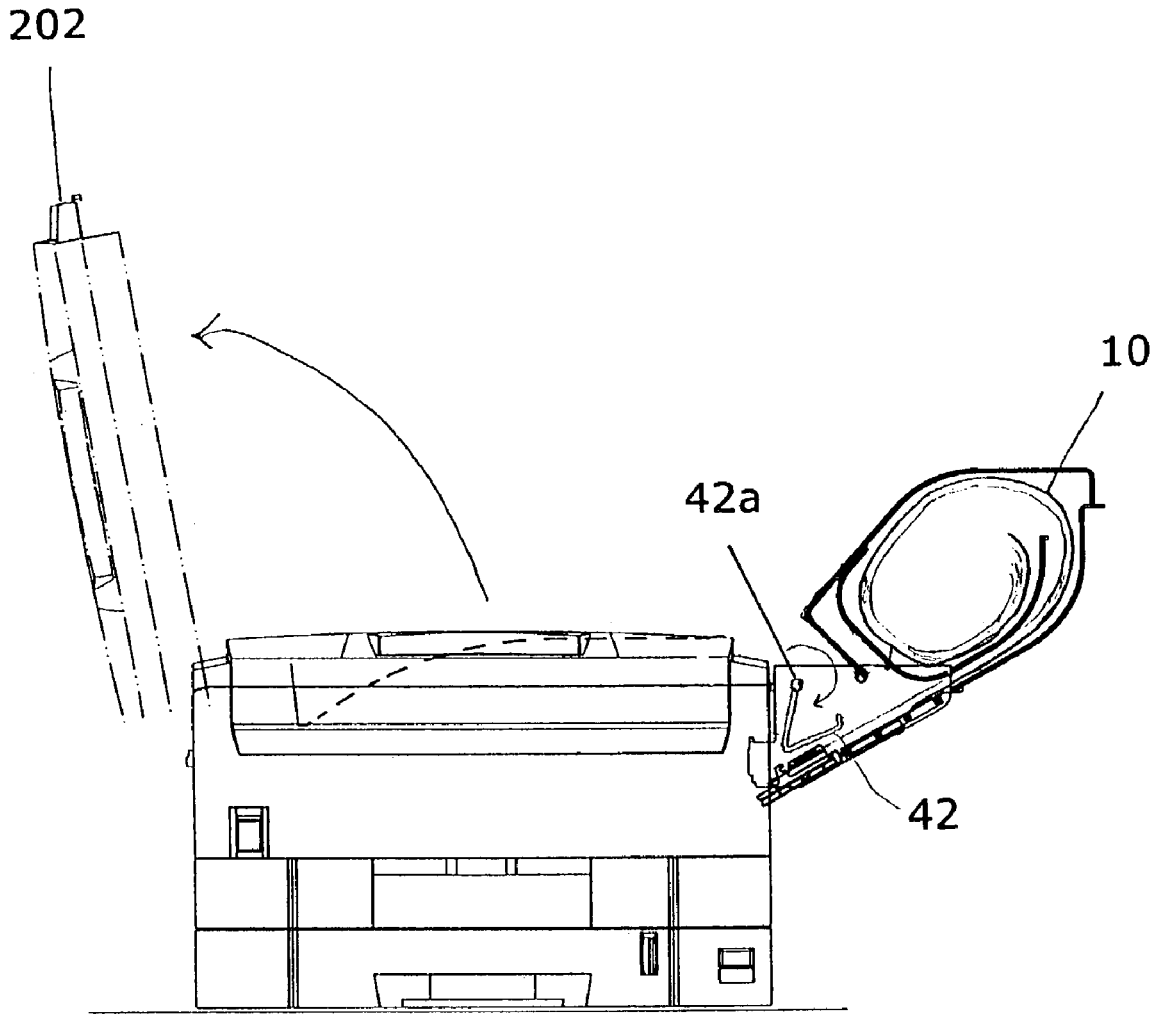
FIG. 18 is a side view of the image recording apparatus of FIG. 15, showing an opening/closing operation of an access cover.

As shown in FIG. 18, in order to open or close the access cover 202, the first upper guide 42 is rotated about a rotation center 42*a* such that it is apart from the access cover 202 so that the space above the access cover 202 is opened.

As described above, according to the seventh embodiment, when setting the lengthy medium, since the lengthy medium is folded and the rear portion of the folded medium is rolled up to be held, the area of the medium tray projecting from the main body is made small. Also, since the stacker for the medium after recording is provided above the main body and the medium tray, the stacker does not project from the main body, thus minimizing the space for installation of the apparatus.

The invention claimed is:

1. An image recording apparatus comprising, a medium tray; and a medium outputting section on an upper face of the image recording apparatus, said medium tray comprising:

a depository in which a plurality of record media is loaded such that front and rear portions of said record media have different angles with respect to a feeding direction of said record media when said record media are in said depository, said depository including a medium support for placing the front portions of the record media and a rear guide extending upwardly from a rear end of the medium support for guiding the rear portions of the record media upwardly, said medium support protruding outside of the image recording apparatus from a side of the image recording apparatus to be exposed; and a folding member provided at a rear portion of said depository for folding the record media so that the rear portions of the record media are folded toward the image recording apparatus with front side surfaces of the record media inward, said folding member being disposed at an upper portion of the rear guide, said folding member including a guide member for guiding the record media toward the image recording apparatus and pressing from above backside surfaces facing upward of the record media thus folded, said medium outputting section outputting said record media carrying an image, wherein said guide member is connected to said upper face so that said record media outputted from said medium outputting section is stacked in said guide member.

2. The image recording apparatus according to claim 1, which further comprises a restricting member arranged at said medium support or rear guide and restricting said record media put in said depository such that said record media are not spaced from said medium support or rear guide more than a predetermined distance and is transported along said medium support or rear guide when said record media are fed into said image recording apparatus.

3. The image recording apparatus according to claim 1, wherein said depository further comprises a curved section between said medium support and rear guide.

4. The image recording apparatus according to claim 1, wherein said folding member is composed of a restricting member which restricts said record media put in said depository such that said record media are not spaced from said depository more than a predetermined distance and is transported along said depository when said record media are fed into said image recording apparatus, said restricting member extending toward the medium support.

5. The image recording apparatus according to claim 1, which further comprises at least one rear supporter provided above said depository at a position closer to the image recording apparatus than that of the folding member for supporting the rear portions of said record media folded at said folding member.

6. The image recording apparatus according to claim 5, wherein said rear supporter is made of at least one shaft.

7. The image recording apparatus according to claim 1, further comprising at least one rear supporter provided above the depository at a position closer to the image recording apparatus than that of the folding member for supporting the rear portion of the record medium folded at the folding member; wherein said at least one rear supporter holds said rear portion of said record medium such that the rear portion is rolled up.

8. The image recording apparatus according to claim 7, wherein said at least one rear supporter is arranged on the guide member so that the guide member is adopted to be rotatable around a fulcrum provided on a main body of the image recording apparatus.

9. The image recording apparatus according to claim 8, wherein said at least one rear supporter is arranged to form an opening for receiving the rear portion of the record medium placed on the medium support when the at least one rear supporter opens.

10. The image recording apparatus according to claim 1, wherein the rear portions of said record media folded at said folding member are supported by an upper surface of said image recording apparatus.

11. The image recording apparatus according to claim 1, wherein said rear guide is made of at least one shaft.

12. The image recording apparatus according to claim 1, wherein said folding member includes an upper guide extending from an top end of the rear guide toward a main body of said image recording apparatus such that the upper guide covers the rear guide, said upper guide being made of at least one shaft.

13. An image recording apparatus comprising, a medium tray; and a medium outputting section on an upper face of the image recording apparatus, said medium tray comprising:

a depository in which a plurality of record media is loaded such that front and rear portions of said record media have different angles with respect to a feeding direction of said record media when said record media are in said depository, said depository including a medium support for placing the front portions of the record media and a rear guide extending upwardly from a rear end of the medium support for guiding the rear portions of the record media upwardly and pressing from above backside surfaces facing upward of the record media, said medium support protruding outside of the image recording apparatus from a side of the image recording apparatus to be exposed; and a folding member provided at a rear portion of said depository such that rear portions of said record media in said depository are folded toward said image recording apparatus with upper surfaces of the record media inward, said folding member being disposed at an upper portion of the rear guide, said folding member being composed of said rear guide and an upper guide extending from a top end of said rear guide toward a main body of said image recording apparatus such that said upper guide covers said rear guide, said medium outputting section outputting said record media carrying an image, wherein said upper guide is connected to said upper face so that said record media outputted from said medium outputting section is stacked in said upper guide.

14. The image recording apparatus according to claim 13, wherein said upper guide can be opened or closed with a side of said main body of said image recording apparatus as a fulcrum.

15. The image recording apparatus according to claim 13, wherein said upper guide comprises a rear supporter disposed at a position closer to the image recording apparatus than that of the rear guide for supporting the rear portions of said record media put in said depository.

16. The image recording apparatus according to claim 13, wherein said depository comprises the medium support for placing the front portion of the record medium and a rear guide extending upwardly from a rear end of the medium support for guiding the rear portion of the record medium upwardly, said folding member is composed of the rear guide and an upper guide extending from a top end of the rear guide toward a main body of the image recording apparatus such that the upper guide covers the rear guide, said upper guide comprises a rear supporter disposed at a position closer to the image recording apparatus than that of the rear guide for supporting the rear portion of the record medium placed in the depository, and said rear supporter holds said rear portion of said record medium such that the rear portion is rolled up by said rear supporter.

17. The image recording apparatus according to claim 16, wherein said at least one rear supporter is arranged on the guide member so that the guide member is adopted to be rotatable around a fulcrum provided on a main body of the image recording apparatus.

18. The image recording apparatus according to claim 17, wherein said at least one rear supporter is arranged to form an opening for receiving the rear portion of the record medium placed on the medium support when the at least one rear supporter opens.

19. The image recording apparatus according to claim 13, wherein said rear guide is made of at least one shaft.

20. The image recording apparatus according to claim 13, wherein said upper guide is made of at least one shaft.

21. The image recording apparatus according to claim 13, wherein said upper face and said upper guide provide a space therebetween in which said rear portions of said record media put in said depository of said medium tray is supported.

22. An image recording apparatus comprising, a medium tray; and a medium outputting section on an upper face of the image recording apparatus, said medium tray comprising:

a depository protruding outside of the image recording apparatus to be exposed for depositing a plurality of record media; and a folding member provided at a rear portion of the depository, said folding member including a guide member for guiding rear portions of the record media to be folded toward the image recording apparatus with front side surfaces of the record media inward and pressing from above backside surfaces of the record media thus folded facing upward, said medium outputting section outputting said record media carrying an image, wherein said guide member is connected to said upper face so that said record media outputted from said medium outputting section is stacked in said guide member.

23. The image recording apparatus according to claim 22, further comprising at least one rear supporter disposed at a position closer to the image recording apparatus than that of the rear guide for supporting the rear portions of the record media.

* * * * *